United States Patent [19]

Klomp et al.

[11] Patent Number: 4,502,635

[45] Date of Patent: Mar. 5, 1985

[54] FUEL INJECTION NOZZLE WITH AUTO-ROTATING TIP

[75] Inventors: Edward D. Klomp, Mt. Clemens; Walter Cornelius, Troy, both of Mich.

[73] Assignee: General Motors Corporation, Detroit, Mich.

[21] Appl. No.: 417,080

[22] Filed: Sep. 13, 1982

[51] Int. Cl.[3] ..... B05B 3/06

[52] U.S. Cl. ..... 239/251; 239/426

[58] Field of Search ..... 239/229, 251, 253, 254, 239/255, 381, 383, 426, 434; 60/744, 745

[56] References Cited

U.S. PATENT DOCUMENTS

| | | | |
|---|---|---|---|
| 1,418,444 | 6/1922 | Josephs, Jr. | 60/745 |
| 2,672,011 | 3/1954 | Von Zborowski . | |
| 2,720,750 | 10/1955 | Schelp . | |
| 2,752,197 | 6/1956 | Marco | 239/251 |
| 2,861,425 | 11/1958 | Williams . | |
| 2,929,442 | 3/1960 | Brola | 60/745 |
| 2,938,345 | 5/1960 | Perle . | |
| 2,998,230 | 8/1961 | Perretti . | |
| 3,125,297 | 3/1964 | Copeland et al. | 239/251 |
| 3,127,924 | 4/1964 | Downs . | |
| 3,204,408 | 9/1965 | Vincent . | |
| 3,469,396 | 9/1969 | Onishi et al. | 60/745 |
| 3,515,353 | 6/1970 | Young et al. | 239/434 |
| 3,932,988 | 1/1976 | Beaufrere . | |
| 3,958,759 | 5/1976 | Timoney | 239/434 |
| 4,257,236 | 3/1981 | Morishita . | |

*Primary Examiner*—Andres Kashnikow
*Assistant Examiner*—Jon M. Rastello
*Attorney, Agent, or Firm*—Saul Schwartz

[57] ABSTRACT

A nozzle for injecting fuel into a combustion zone including a stationary nozzle body having a main fuel passage therethrough connected to a source of fuel under pressure, an auto-rotating tip disposed on the nozzle body for rotation about a main axis of the latter, a fuel distribution cavity between the tip and the nozzle body connected to the main fuel passage and filled with pressurized fuel, and a plurality of fuel passages in the tip exposed to pressurized fuel in the distribution cavity. Each of the fuel passages is disposed in a plane perpendicular to the main axis and is slanted relative to one of a corresponding plurality of radii emanating from the main axis so that jets of fuel issuing from the fuel passages develop reaction forces on the tip having components tangent to a circle about the main axis which reaction forces spin the tip to disperse fuel in the combustion zone in a volume of revolution about the main axis.

6 Claims, 6 Drawing Figures

FUEL INJECTION NOZZLE WITH AUTO-ROTATING TIP

BACKGROUND OF THE INVENTION

1. Field of the Invention

This invention relates generally to combustion apparatus and, more particularly, to nozzles for injecting fuel into combustion zones.

2. Description of the Prior Art

In combustion apparatus such as gas turbine engines or diesel engines, an important factor relating to optimization of the combustion process is fuel distribution within the combustion zone. In engines where fuel issues from a point source, as for example from a nozzle having an orifice of very small diameter relative to the diameter of the surrounding combustion zone, distribution is a function of spray penetration and radial dispersion. While to some extent deficiencies in either of these two areas can be compensated for by control of air flow into the combustion zone, excessive air flow control can result in abnormally high and undesirable pressure drops across gas turbine engine combustors or reductions in volumetric efficiencies in diesel engines. As a further complication, spray penetration and radial dispersion are often in conflict. For example, increased spray penetration is achieved by increased injection pressure but radial dispersion generally implies increased flow area and, for a fixed flow rate, reduced injection pressure. In addition, in nozzles which spray fuel radially from multiple ports, increasing the number of ports to achieve more uniform distribution without increased flow rate can result in port diameters becoming objectionably small.

Efforts to compromise these conflicting considerations have led to proposals for rotating nozzle arrangements of the slinger type wherein fuel is directed at a rotor and splashed or otherwise dispersed by the rotor into a combustion zone. In another, similar proposal fuel is directed radially against an inner frustoconical surface of a rotor whereat the rotation of the rotor spreads the fuel into an even film which vaporizes in air flowing over the surface. And in still another rotating nozzle system, fuel is directed to a main cavity in a rotor and then, under centrifugally induced pressure, through passages leading to the combustion zone. While these proposals may achieve their stated objectives, each requires separate means for rotating the rotor which separate means complicate the arrangement and increase potential manufacturing costs. A new and improved nozzle according to this invention represents an advance over these and other known fuel injection nozzles having rotors for fuel distribution.

SUMMARY OF THE INVENTION

The primary feature, then, of this invention is that it provides a new and improved nozzle for injecting fuel into a combustion zone. Another feature of this invention is that it provides a new and improved nozzle wherein fuel is dispersed from an auto-rotating tip into a combustion zone, the auto-rotating tip having no independent driving means other than the pressure of the fuel being delivered to the nozzle. Still another feature of this invention resides in the provision in the new and improved nozzle of a nozzle body and an auto-rotating tip disposed on the body for rotation about an axis of the latter, the tip having a plurality of fuel passages therethrough communicating with a main fuel passage in the body so that fuel jets issuing from the passages develop reaction forces on the tip having components tangent to the axis of rotation whereby the tip is caused to rotate and distribute the fuel in a volume of revolution in the combustion zone. Yet another feature of this invention resides in the provision in one embodiment of the new and improved nozzle of a valve which prevents fuel from reaching the auto-rotating tip until the pressure of the fuel exceeds a predetermined magnitude so that fuel is injected into the combustion zone in a volume of revolution and in pulses. These and other features of this invention will be readily apparent from the following specification and from the drawings wherein:

Figure 1:
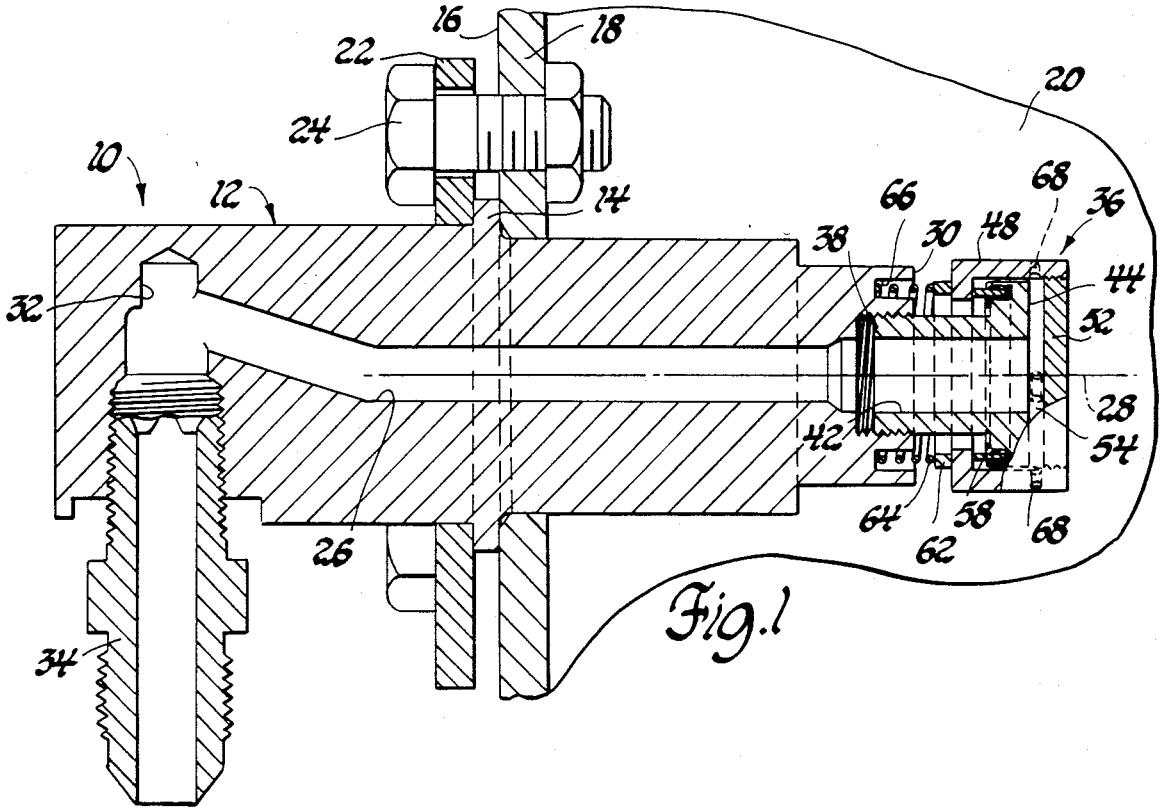
FIG. 1 is a sectional view of a new and improved fuel nozzle according to this invention.

Referring now to FIG. 1 of the drawings, a new and improved fuel nozzle according to this invention and designated generally 10 includes a generally cylindrical nozzle body 12 having an annular flange 14 extending therearound. The flange 14 abuts an outer surface 16 of a wall 18 representative of either a gas turbine engine combustor wall or a diesel engine cylinder head. In either case, a combustion zone 20 is defined generally in the area to the right of wall 18 so that the nozzle body 12 projects through the wall into the combustion zone. An annular collar 22 is fitted around the nozzle body 12 outboard of flange 14 and is attached to the wall 18 by a plurality of threaded fasteners 24 so that the flange 14 is captured between the collar 22 and the wall 18 and the nozzle body is retained on the wall. The nozzle body 12 has a main fuel passage 26 extending axially along a longitudinal axis 28 of the nozzle body between an inboard end 30 of the latter and a cross bore 32 intersecting the main passage generally at the opposite end of the nozzle body. A connector 34 is threaded into the nozzle body at the cross bore 32 and is connected to a source of fuel, not shown, wherefrom fuel at predetermined pressure is delivered to the main passage 26.

Figure 2:
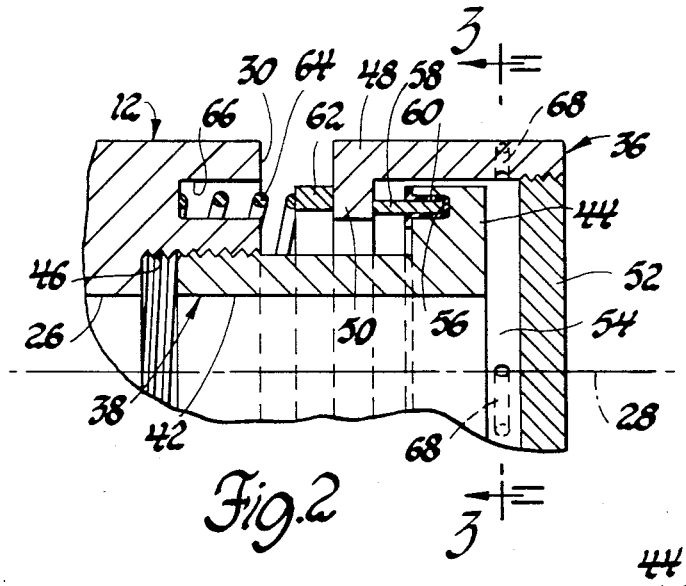
FIG. 2 is an enlarged view of a portion of FIG. 1 showing the auto-rotating tip portion of the nozzle.

Referring now to FIGS. 1 and 2, an auto-rotating tip assembly 36 is disposed on the nozzle body 12 within the combustion zone 20. The tip assembly 36 includes a cylindrical support sleeve 38 having a bore 42 therethrough and an integral annular flange 44 at one end thereof. The support sleeve is threaded into a counterbore 46 in the nozzle body 12 such that the bore 42 is aligned with main fuel passage 26. The tip assembly 36 further includes a cylindrical rotor 48 having an inturned annular flange 50 integral therewith. The rotor 48 is received around annular flange 44 of the support sleeve 38 so that the rotor is supported on the nozzle body for rotation about the axis 28. The open end of the rotor is closed by a cap 52 threaded into the rotor or otherwise retained thereon. In a normally assembled position of the rotor 48 relative to the support sleeve 38, FIGS. 1 and 2, a cylindrical fuel distribution cavity 54 is formed between the cap 52 and the annular flange 44, the distribution cavity being in fluid communication with the bore 42 and the main fuel passage 26 so that the distribution cavity contains fuel at whatever pressure the latter is delivered to the nozzle body.

As seen best in FIG. 2, a circular groove 56 is formed in the left facing surface of flange 44 of the support sleeve 38 and receives a cylindrical seal element 58, the seal element being spaced or insulated from the flange 44 by a boot 60. A carbon bearing ring 62 slidably engages the left facing surface of annular flange 50 of the rotor 48 and is maintained against the flange by a spring 64 seated at one end against the carbon ring and at the other end against the base of a groove 66 in the inboard end 30 of the nozzle body 12. The spring 64 operates through the carbon ring 62 to bias the inboard or right facing surface of the flange 50 against the circular edge of seal element 58 so that fuel leakage from the distribution cavity 54 around the flange 44 of the support sleeve 38 is prevented.

Figure 3:
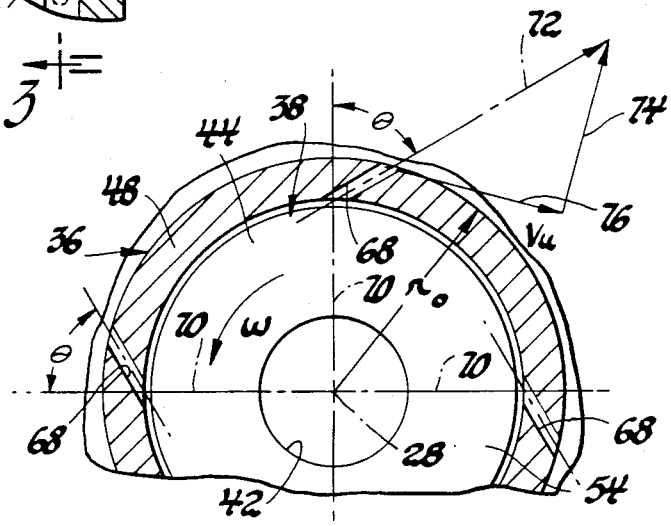
FIG. 3 is a sectional view taken generally along the plane indicated by lines 3—3 in FIG. 2.

Referring particularly now to FIGS. 1, 2 and 3, a plurality of fuel passages or ports 68 are formed in the rotor 48 and provide communication between the outer surface of the rotor and the fuel distribution cavity 54. Each of the passages 68 is disposed generally in a plane perpendicular to the longitudinal axis 28 of the nozzle body. In addition, each of the passages 68 is disposed at an angle $\theta$ relative to a corresponding one of a plurality of radii 70 in the plane defined by the passages. In operation, then, fuel under pressure in distribution cavity 54 flows equally and simultaneously through the passages 68 and issues into the combustion zone 20 in a plurality of jets, only a single jet represented by a vector arrow 72 being shown in FIG. 3. Relative to rotor 48, the jet represented by vector arrow 72 has a radial component 74 which carries the fuel radially outward from longitudinal axis 28 and a component 76 tangent to the circle about longitudinal axis 28 defined by the outer surface of rotor 48. The tangential component 76 imparts a reaction force on the rotor which spins or rotates the latter in a counterclockwise direction, FIG. 3, about the axis 28 at an angular velocity having a proportional relationship to the pressure of the fuel in the distribution cavity 54. As the rotor spins, the fuel jets issuing from each of the passages 68 rotate around the longitudinal axis 28 so that the fuel jets define a volume of revolution within the combustion zone 20 in which volume the fuel is dispersed.

Having thus described the operation of the nozzle 10, and particularly the auto-rotating tip assembly 36, certain advantages will be evident. More particularly, since the rotor 48 is powered or driven only by the reaction force developed by the tangential component of each of the fuel jets, there is no need for auxiliary or separate means for driving the rotor. In addition, uniform circumferential distribution of fuel around the axis 28 is assured regardless of the placement or the number of passages 68. Accordingly, depending upon the fuel flow requirements of the particular combustion apparatus, a fewer number of larger diameter passages are permissible without incurring the concomitant disadvantage of conventional nozzle designs. Still further, it will be apparent that while the passages 68 are shown disposed in a common place perpendicular to longitudinal axis 28, each passage may additionally be canted axially in a downstream or rightward direction, FIG. 2, so that the volume of revolution defined by the fuel jets is generally cone-shaped rather than cylindrical as would occur in the embodiment shown in FIGS. 1, 2 and 3.

Figure 4:
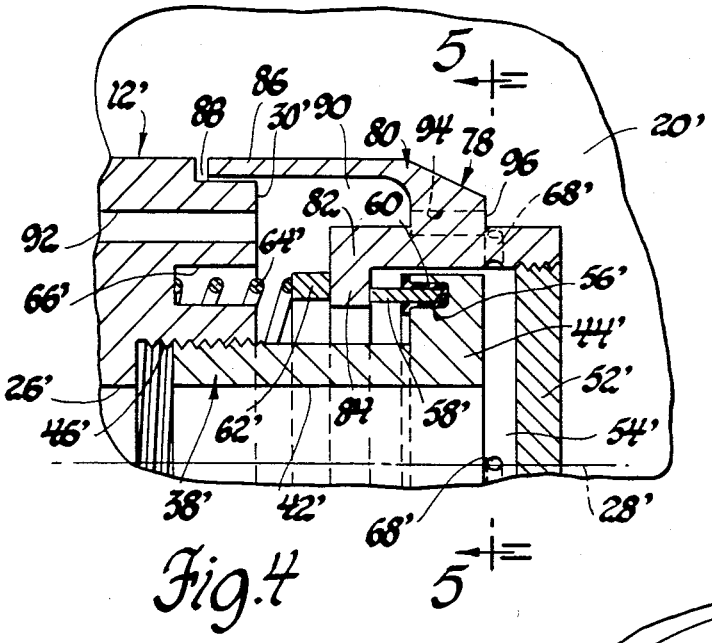
FIG. 4 is similar to FIG. 2 but showing a nozzle having a first modified auto-rotating tip.
Figure 5:
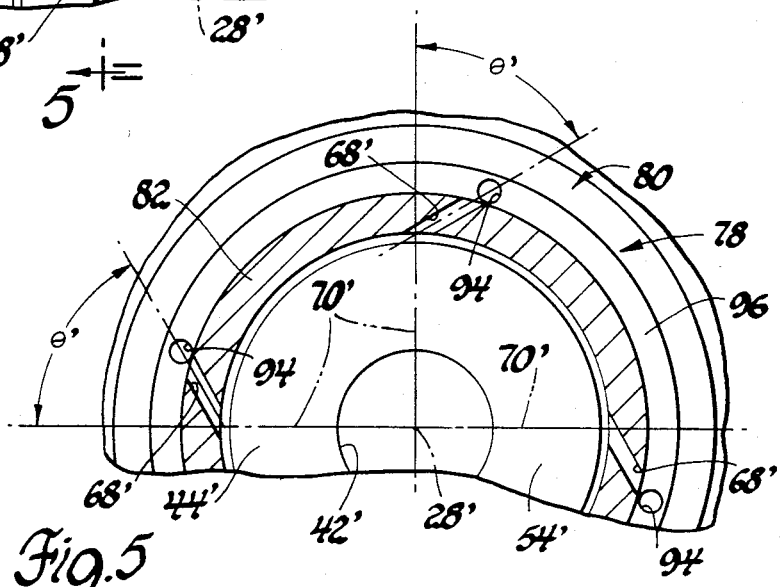
FIG. 5 is a view taken generally along the plane indicated by lines 5—5 in FIG. 4.

Referring now to FIGS. 4 and 5 wherein elements of structure finding physical and functional correspondence in fuel nozzle 10 are identified with primed reference characters, a first modified auto-rotating tip assembly 78 is disposed on the rightward end of nozzle body 12' within the combustion zone 20'. The first modified tip assembly 78 includes a support sleeve 38' threaded into a counterbore 46' in the nozzle body 12' such that a bore 42' in the sleeve registers with the main fuel passage 26' in the nozzle body. A modified rotor 80 includes a cylindrical body portion 82 rotatably supported on the outer cylindrical surface of annular flange 44' of the support sleeve 38' and an inturned flange 84 integral with the cylindrical body portion 82. A cap 52' sealingly closes the center of modified rotor 80 to the right of support sleeve 38' and cooperates with the latter in defining the fuel distribution cavity 54'. The rightward surface of inturned flange 84 bears against the circular edge of a seal element 58', the latter being disposed in a circular groove 56' in the flange 44' and separated from the latter by boot 60'. A carbon ring 62' bears against the leftward surface of flange 84 and is maintained against the flange by a spring 64' which seats at one end against the carbon ring and at the other end against the base of a groove 66' in the nozzle body. Accordingly, fuel delivered to the main passage 26' is conveyed to the distribution cavity 54' through the bore 42' and is prevented from escaping between the modified rotor 80 and the support sleeve 38' by the seal element 58'.

With continued reference to FIGS. 4 and 5, the modified rotor 80 further includes a plurality of fuel passages 68' extending through the body portion 82 and disposed in a plane perpendicular to the longitudinal axis 28'. Each of the passages 68' is disposed at an angle $\theta'$ relative to a corresponding one of a plurality of radii 70' in the plane of the passages so that fuel jets issuing from the passages include velocity components directed tangent to a circle about longitudinal axis 28'. The fuel jets thus react on the modified rotor 80 causing the latter to spin or rotate about the longitudinal axis 28'.

The modified rotor 80 further includes an integral skirt portion 86 extending leftward or upstream from adjacent the plane defined by passages 68'. The skirt portion 86 surrounds the support sleeve 38' and nests in an annular groove 88 in the nozzle body 12' generally at the inboard end 30' thereof. The skirt portion 86 thus cooperates with the nozzle body 12' and the support sleeve 38' in defining an air plenum 90 connected to a source of pressurized air through a passage 92 in the nozzle body 12'. A plurality of axially extending air passage 94, FIG. 5, extend through the skirt portion 86 from the plenum 90 to a surface 96 on the modified rotor. The air passages 94 correspond in number to the number of fuel passages 68' and are located such that each of the air passages 94 registers with or generally overlies one of the passages 68' at the latters+ intersection with the outer surface of the body portion 82. Accordingly, when pressurized air is present in plenum 90 and pressurized fuel is present in distribution cavity 54', the fuel jets issuing from the passages 68' spin the rotor 80 while air jets, directed generally parallel to the longitudinal axis 28', intercept the fuel jets to disperse the jets even more fully than otherwise is the case. Therefore, in operation of the modified tip assembly 78 the volume of revolution defined by the rotating fuel jets is expanded for more complete dispersion of the fuel within the combustion zone.

Figure 6:
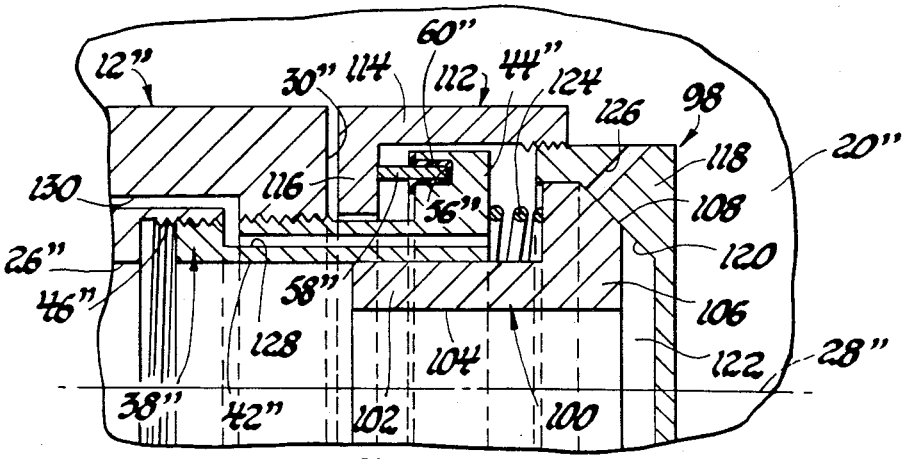
FIG. 6 is similar to FIGS. 2 and 4 but showing a nozzle having a second modified auto-rotating tip.

Referring now to FIG. 6 wherein elements of structure finding physical and functional correspondence in fuel nozzle 10 are identified with double primed reference characters, a second modified auto-rotating tip assembly 98 primarily for diesel engine applications is disposed on the rightward end of nozzle body 12" within the combustion zone 20". The second modified tip assembly includes a support sleeve 38" threaded into a counterbore 46" in the nozzle body such that a bore 42" in the support sleeve registers with main fuel passage 26". A valve element 100 has a shank 102 with an axial bore 104 therethrough slidably disposed in the bore 42" of the support sleeve 38". The valve element further includes a head 106 defining a frustoconical seat 108. A rotor 112 includes a cylindrical skirt 114 rotatably supported on a flange 44" of the support sleeve 38". The cylindrical skirt 114 has an integral inturned flange 116 in juxtaposition with inboard end 30" of the nozzle body. A cylindrical cap 118 threads into or is otherwise rigidly attached to the cylindrical skirt 114 and includes frustoconical surface 120 engaged by the valve seat 108 on the valve element 100, the cap and the valve element cooperating in defining a variable volume fuel distribution cavity 122. A cylindrical seal element 58" is disposed in a groove 56" in flange 44" of the support sleeve and is separated therefrom by a boot 60". A spring 124 seats at one end against the head 106 of valve element 100 and at the other end against support sleeve 38", the spring 124 thereby urging the valve element into engagement on the cap 118 and the rotor 112 rightwardly against seal element 58" to prevent fuel leakage. A plurality of fuel passages 126 corresponding to passages 68 and 68' in tip assemblies 36 and 78, respectively, extend through the cap 118 from the surface 120. The passages are disposed at angles to corresponding radii in a plane perpendicular to axis of rotation 28" and are canted downstream to project the fuel jets issuing therefrom rightward into the combustion zone.

Describing now the operation of the second modified tip assembly 98, spring 124 normally biases the valve element 100 against the surface 120 to seal the inboard ends of fuel passages 126 so that no fuel escapes from fuel distribution cavity 122. In addition, spring 124 biases the rotor 112 rightward so that seal element 58" prevents escape of fuel between the rotor 112 and the support sleeve 38". In the diesel engine application, fuel delivery means provide pulses of high pressure fuel to the main fuel passage 26" and, through bores 42" and 104 to the distribution cavity 122. The pressurized fuel acts in opposition to the spring 124 on the valve element and functions to move the latter to an open position, not shown, exposing the innermost ends of fuel passages 126 when the fuel pressure achieves a predetermined minimum magnitude. When the valve element achieves the open position fuel immediately discharges through the passages 126 and issues from the outermost ends thereof in jets having axial and tangential components so that when the valve element is in the open position fuel is dispersed downstream into the combustion zone 20" while the tangential components spin the rotor as described hereinbefore. At the completion of the injection cycle, the fuel pressure in distribution cavity 122 decreases allowing spring 124 to move the valve element 100 back to the closed position terminating communication between the passages 126 and the distribution cavity. With the flow of fuel through the passages thus terminated the injection ceases and rotor 112 stops spinning. To prevent accumulation of fuel which might leak around valve element 100, a fuel relief passage 128 in the support sleeve 38" communicates with the volume between the valve element and the support sleeve and registers with a second relief passage 130 in the nozzle body 12" which exhausts leakage fuel to an appropriate receptacle.

The embodiments of the invention in which an exclusive property of privilege is claimed are defined as follows:

1. In a nozzle for injecting fuel into a combustion zone maintained at a zone pressure above atmospheric, the combination comprising, a source of combustible fuel at a supply pressure exceeding said zone pressure, a stationary nozzle body having a main fuel passage means of predetermined flow area in communication with said fuel source and aligned on an axis of said nozzle body, means on said nozzle body defining a stationary annular seal flange around said passage means in a plane perpendicular to said axis, an auto-rotating tip disposed on said nozzle body around said seal flange for rotation about said axis and cooperating with said nozzle body in defining a distribution cavity in communication with said passage means so that pressurized fuel in said distribution cavity urges separation between said nozzle body and said auto-rotating tip, means defining an inturned annular flange on said auto-rotating tip disposed on the opposite side of said seal flange from said distribution cavity so that pressurized fuel in said distribution cavity urges said inturned flange toward said seal flange, means defining a plurality of equal sized fuel passages in said auto-rotating tip communicating with said distribution cavity and having combined flow areas less than said predetermined flow area so that a high velocity jet of fuel issues from each of said fuel passages when pressurized fuel is present in said distribution cavity, each of said high velocity jets producing a reaction force on said auto-rotating tip having a component directed tangent to a circle about said axis so that said high velocity jets spin said tip whereby fuel is dispersed in a volume of revolution about said axis, and means defining a rubbing seal between said inturned flange and said seal flange operative to prevent escape of pressurized fuel therebetween from said distribution cavity.

2. The combination recited in claim 1 wherein each of said reaction forces produced by said high velocity jets further includes a component directed parallel to said main axis so that said volume of revolution in which fuel is dispersed is bounded on the outside by a cone.

3. In a nozzle for injecting fuel into a combustion zone maintained at a zone pressure above atmospheric, the combination comprising, a source of combustible fuel at a supply pressure exceeding said zone pressure, a source of air at a supply pressure exceeding said zone pressure, a stationary nozzle body having a main fuel passage means of predetermined flow area in communication with said fuel source and aligned on an axis of said nozzle body and an air passage connected to said air source, means on said nozzle body defining a stationary annular seal flange around said fuel passage means in a plane perpendicular to said axis, an auto-rotating tip disposed on said nozzle body around said seal flange for rotation about said axis and cooperating with said nozzle body in defining a distribution cavity in communication with said fuel passage means so that pressurized fuel in said distribution cavity urges separation between said nozzle body and said auto-rotating tip, means defining an inturned annular flange on said auto-rotating tip disposed on the opposite side of said seal flange from said distribution cavity so that pressurized fuel in said distribution cavity urges said inturned flange toward said seal flange, means defining a plurality of equal sized fuel passages in said auto-rotating tip communicating with said distribution cavity and having combined flow areas less than said predetermined flow area so that a high velocity jet of fuel issues from each of said fuel passages when pressurized fuel is present in said distribution cavity, each of said high velocity jets producing a reaction force on said auto-rotating tip having a component directed tangent to a circle about said axis so that said high velocity jets spin said tip whereby fuel is dispersed in a volume of revolution about said axis, means defining a rubbing seal between said inturned flange and said seal flange operative to prevent escape of pressurized fuel therebetween from said distribution cavity, means defining an air plenum between said auto-rotating tip and said nozzle body connected to said air passage so that said plenum is filled with pressurized air, and means defining a plurality of air passages in said auto-rotating tip corresponding in number to the number of said fuel passages and communicating with said plenum, each of said air passages being operative to direct a stream of air across a corresponding one of said high velocity jets thereby to expand said volume of revolution and further disperse said fuel.

4. The combination recited in claim 3 wherein each of said reaction forces produced by said high velocity jets further includes a component directed parallel to said main axis.

5. In a nozzle for injecting fuel into a combustion zone maintained at a zone pressure above atmospheric, the combination comprising, a source of combustible fuel at a supply pressure exceeding said zone pressure, a stationary nozzle body having a fuel supply passage connected to said fuel source and aligned on an axis of said nozzle body, means on said nozzle body defining a stationary annular seal flange around said fuel passage in a plane perpendicular to said axis, an auto-rotating tip disposed on said nozzle body around said seal flange for rotation abouty said axis and cooperating with said nozzle body in defining a distribution cavity in communication with said fuel passage so that pressurized fuel in said distribution cavity urges separation between said nozzle body and said auto-rotating tip, means defining an inturned annular flange on said auto-rotating tip disposed on the opposite side of said seal flange from said distribution cavity so that pressurized fuel in said distribution cavity urges said inturned flange toward said seal flange, means defining a plurality of equal sized fuel passages in said auto-rotating tip communicating with said distribution cavity and being operative to restrict fuel flow from said distribution cavity so that high velocity fuel jets issue from each of said tip fuel passages when pressurized fuel is present in said distribution cavity, each of said high velocity jets producing a reaction force on said auto-rotating tip having a component directed tangent to a circle about said axis so that said high velocity jets spin said tip whereby fuel is dispersed in a volume of revolution about said axis, means defining a rubbing seal between said inturned flange and said seal flange operative to prevent escape of pressurized fuel therebetween from said distribution cavity, a valve element disposed on said nozzle body for movement between a closed position preventing communication between said tip fuel passages and said distribution cavity and an open position permitting communication between said tip fuel passages and said distribution cavity, said valve element being exposed to said pressurized fuel and being urged thereby toward said open position, and spring means between said nozzle body and said valve element biasing said valve element toward said closed position so that no fuel traverses said tip fuel passages until the pressure of said fuel in said distribution cavity moves said valve element to said open position by achieving a magnitude sufficient to overcome the force of said spring means.

6. The combination recited in claim 5 wherein each of said reaction forces produced by said high velocity jets further includes a component directed parallel to said main axis so that said volume of revolution in which fuel is dispersed is bounded on the outside by a cone.

* * * * *